US005727784A

United States Patent [19]

Sagawa

[11] Patent Number: 5,727,784

[45] Date of Patent: Mar. 17, 1998

[54] PAPER FEEDER

[75] Inventor: Takizo Sagawa, Kanagawa, Japan

[73] Assignee: Fuji Xerox Co., Ltd., Tokyo, Japan

[21] Appl. No.: 773,999

[22] Filed: Dec. 26, 1996

Related U.S. Application Data

[63] Continuation of Ser. No. 418,413, Apr. 7, 1995, abandoned.

[30] Foreign Application Priority Data

May 16, 1994 [JP] Japan ..... 6-124669

[51] Int. Cl.[6] ..... B65H 7/02

[52] U.S. Cl. ..... 271/265.01; 271/242; 271/272; 271/188

[58] Field of Search ..... 271/242, 258.01, 271/265.01, 272, 264, 164, 188, 314

[56] References Cited

U.S. PATENT DOCUMENTS

| | | | |
|---|---|---|---|
| 4,878,657 | 11/1989 | Ura et al. | 271/242 |
| 5,022,642 | 6/1991 | Hasegawa et al. | 271/242 |
| 5,362,041 | 11/1994 | Ryuzaki et al. | 271/242 |
| 5,383,655 | 1/1995 | Hayakawa et al. | 271/164 |

FOREIGN PATENT DOCUMENTS

| | | | |
|---|---|---|---|
| 56-22540 | 2/1981 | Japan . | |
| 60-120461 | 8/1985 | Japan . | |
| 0197344 | 9/1986 | Japan | 271/242 |
| 62-244842 | 10/1987 | Japan . | |
| 1-172540 | 12/1989 | Japan . | |
| 1-174353 | 12/1989 | Japan . | |
| 404313569 | 11/1992 | Japan | 271/314 |
| 405294505 | 11/1993 | Japan | 271/258.01 |

*Primary Examiner*—H. Grant Skaggs

*Attorney, Agent, or Firm*—Finnegan, Henderson, Farabow, Garrett & Dunner, L.L.P.

[57] ABSTRACT

A paper feeder capable of preventing a sheet of paper from breaking when a paper jam is developed within an image forming apparatus over the boundary between a paper conveying unit and the image forming apparatus and simply removing the jammed paper outside from the paper feeder. An entrance roller pair for feeding the paper is provided in the neighborhood of an entrance of a paper conveying path. A lower fixed guide member and a rotatable guide member opposed to each other so as to interpose the paper conveying path therebetween, are provided on the downstream side as seen in a paper feeding direction. Further, a jump portion which projects in convex form at a position opposed to the rotatable guide member and a paper sensor for detecting a rear end of the paper in the neighborhood of the entrance roller pair are provided. The rotatable guide member is rotatably supported by a support shaft provided on the downstream side as seen in the paper feeding direction and is urged toward the fixed guide member by the mass of a weight or the like. When the paper jam is developed, a paper feeding operation is continued until the rear end of the paper enters into the paper conveying unit and the paper is folded between the rotatable guide member and the fixed guide member.

5 Claims, 4 Drawing Sheets

PAPER FEEDER

This is a continuation of application Ser. No. 08/418,413, filed Apr. 7, 1995, now abandoned

BACKGROUND OF THE INVENTION

1. Field of the Invention

The present invention relates to a paper feeder which is suitable for use in an image forming apparatus such as a copier or a printer to which an electrophotographic process is applied, and which successively feeds sheets of paper with images transferred and fixed thereon one by one.

2. Description of the Related Art

An image forming apparatus such as a copier or a printer is provided with a paper feeder for successively conveying sheets of paper held within each of paper trays to a transfer unit one by one, feeding the paper with a toner image transferred thereon to a fixing unit and delivering it to a paper delivery or take-off device. In the paper feeder, a paper conveying path is formed by two guide members for supporting a sheet of paper from both surfaces thereof. Further, a plurality of roller pairs for feeding out the paper are provided so as to deliver the paper in a predetermined direction under their rotation.

There is a case in which, for example, when a sheet of paper is bent or when each of sheets of paper different in rigidity from each other is used, a paper jam that makes a failure to normally feed the paper, is developed in the paper conveying path referred to above. When such a paper jam takes place, it is necessary to open the paper conveying path and remove the jammed paper therefrom. Means for attaining that purpose have been disclosed in Japanese Utility Model Laid-Open Nos. Sho 56(1981)-22540, Hei 1(1989)-174353 and Sho 60(1985)-120461, for example.

Each of the paper feeders disclosed in Japanese Utility Model Laid-Open Nos. Sho 56(1981)-22540 and Hei 1(1989)-174353 is provided with a guide member movable in the direction of opening a paper conveying path owing to improper pressure of a sheet of paper and is activated so as to move the guide member when a paper jam occurs while the paper is being fed, thereby permitting the pressure applied to the paper to escape. The paper feeder disclosed in Japanese Utility Model Laid-Open No. Sho 60(1985)-120461 is one in which in order to permit the pressure exerted on the paper to escape in the same manner as described above, a guide member is forcedly rotated when a paper jam takes place to thereby withdraw the guide member from other guide member opposed to the guide member.

However, a paper feeder is also known in which it is difficult to avoid or solve a paper jam by simply opening a paper conveying path because a sufficient space cannot be taken within an image forming apparatus depending on the disposition of the paper conveying path. In the paper feeder referred to above, a part of the paper conveying path is formed by a plurality of paper conveying units supported so as to be drawable in a direction orthogonal to a paper feeding direction.

In this type of paper feeder, a paper sensor for sensing the paper jam is provided at a suitable position of the paper conveying path. When the paper jam is detected by the paper sensor, the position of the paper jam is notified to a display unit of the image forming apparatus. An operator draws a corresponding paper conveying unit based on the representation of the above position on the display unit and removes the jammed paper outside from the paper feeder. As a result, the operation of the image forming apparatus can be resumed.

However, the aforementioned paper feeder has a problem that if one of the two paper conveying units, which has been displayed on the display unit as it is, is pulled out where the paper jam takes place and the paper is stopped over the two paper conveying units, then the paper is broken because a part of the paper is left in the other paper conveying unit. The paper feeder also causes inconvenience that when the paper is ruptured in this way, the other paper conveying unit must be pulled out to remove the residual paper, thereby making its operation cumbersome and the broken paper enters deep the paper feeder, thereby making it difficult to remove the paper.

As ones for avoiding such inconvenience, paper feeders disclosed in Japanese Patent Laid-Open Nos. Sho 62(1987)-244842 and Hei 1(1989)-172540, for example, have been proposed.

The paper feeder disclosed in Japanese Patent Laid-Open No. Sho 62(1987)-244842 is one in which a paper sensor is provided at the boundary between two paper conveying units and when a paper jam is sensed by the paper sensor, the corresponding paper conveying unit is prevented from being pulled out of the paper feeder.

The paper feeder disclosed in Japanese Patent Laid-Open No. Hei 1(1989)-172540 is one in which a portion where two paper conveying units are joined to each other is contrived or devised, that is, a frontage of a portion for receiving a sheet of paper on the downstream side as seen in a paper feeding direction is set wide so that paper having the maximum length is folded and forced therein.

However, the aforementioned paper feeders respectively involve the following problems.

The paper feeder described in Japanese Patent Laid-Open No. Sho 62(1987)-244842 has a problem that although the paper can be prevented from breaking because the paper conveying unit cannot be pulled out upon paper jamming, no proposal about the removal of the jammed paper is put forward, thus making it difficult to remove the paper jammed at the boundary between the paper conveying units.

Further, the paper feeder disclosed in Japanese Utility Model Laid-Open No. Hei 1(1989)-172540 involves a problem that the paper folded when the paper conveying unit provided on the downstream side is pulled out, cannot be restrained from projecting toward the paper conveying unit on the downstream side, thereby making it unable to completely prevent the paper from breaking. A problem also arises that the time required for the paper to pass through the frontage greatly varies because the frontage of the paper passing portion of the paper conveying unit is wide, thereby making it difficult to control the time.

SUMMARY OF THE INVENTION

With the foregoing problems in view, it is an object of the present invention to provide a paper feeder capable of preventing a sheet of paper from breaking when a paper jam takes place over the boundary between paper conveying units and simply removing the jammed paper outside from the paper feeder.

According to one aspect of this invention, there is provided a paper feeder comprising a paper conveying unit supported so as to be drawable in a direction in which a part of a paper conveying path meets at a right angle to a paper feeding direction, comprising an entrance roller pair provided in the neighborhood of an entrance of the paper conveying path in the paper conveying unit and for allowing a sheet of paper while being fed to continue feeding until a rear end thereof enters the paper conveying unit even if a paper jam is detected within the paper conveying unit; a fixed guide member provided on the side of one side of the paper conveying path extending on the downstream side of the entrance roller pair; a rotatable guide member opposed to the fixed guide member with the paper conveying path interposed therebetween and having a turnably-supported end thereof extending in the paper feeding direction; and urging means for urging the rotatable guide member toward the fixed guide member.

In the above paper feeder as defined in claim 2, the paper conveying path defined between the fixed guide member and the rotatable guide member has a portion bent so as to become convex on the rotatable guide member side.

The paper feeder rotatable guide member is rotatably supported by a support point provided in the neighborhood of one end thereof extending in the paper feeding direction. The shape, dimensions and the like of the rotatable guide member can be suitably set. Further, the position of the support point Of the rotatable guide member can be suitably set. It is, however, desirable in particular that the rotatable guide member is supported by the support point provided on the downstream side as seen in the paper feeding direction.

It is desirable that the urging means is set so as to be able to obtain pressure equivalent to such an extent that a paper loop developed in the neighborhood of the rotatable guide member can be squashed when the entire paper is forced into its corresponding paper conveying unit. The structure of the urging means can be suitably set. However, its structure can be set by the mass of the rotatable guide member or the member fixed to the rotatable guide member.

In the paper feeder as defined in claim 2, it is necessary to suitably set the configuration of the guide member corresponding to the portion of the paper conveying path, which is bent so as to become convex on the rotatable guide member side. Described specifically, when the paper is fed along the bent portion, the guide member is set to a shape of such an extent that it is possible to make an opportunity of bringing the paper into a loop.

In the paper feeder, the entrance roller pair is provided in the neighborhood of the entrance of the paper conveying path in the paper conveying unit. Even if the paper jam is detected within the paper conveying unit, the delivery of the paper is continued until the rear end of the paper while being fed enters the paper conveying unit. The paper conveying unit includes therein the rotatable guide member opposed to the fixed guide member and having the one end thereof rotatably supported, and the urging means for urging the rotatable guide member toward the fixed guide member. Therefore, when the paper jam takes place within the paper conveying unit, the paper is fed by the entrance roller pair from the upstream side as seen in the paper feeding direction. Thus, a loop of the paper is formed between the rotatable guide member and the fixed guide member. Under the pressure developed by the loop, the rotatable guide member is rotated in the direction of opening the paper conveying path with the one end thereof taken as a fulcrum. When the paper loop becomes great to some extent, the rotatable guide member does not endure an urging force produced from the urging means. As a result, the rotatable guide member is pulled back toward the fixed guide member so as to squash the loop of the paper. Further, when the feeding of the paper by the entrance roller pair is continued, the paper forms a loop again. When the loop becomes great to some extent, it is squashed. This operation is repeated until the rear end of the paper is fed into the paper conveying unit. As a result, the paper is folded between the rotatable guide member and the fixed guide member so as to be completely accommodated within a narrow range in the paper conveying unit. Therefore, the jammed paper can be easily eliminated outside from the paper feeder by pulling out the paper conveying unit, thereby making it possible to prevent the paper from breaking.

Since the paper feeder paper conveying path is bent so as to become convex on the rotatable guide member side, the paper is further flexed toward the rotatable guide member at the bent portion when a paper jam occurs in the neighborhood of the leading end portion of the paper, thereby making an opportunity of forming the loop of the paper. Therefore, a paper folding operation can be made smoother to thereby make it able to easily accommodate the paper within the paper conveying unit.

Since the paper feeder, rotatable guide member is rotated by a support point provided on the downstream side as seen in the paper feeding direction, a paper loop is formed toward the upstream side from the neighborhood of the support point by feeding the paper into the paper conveying unit from the upstream side under the rotation of the entrance roller pair. Therefore, the operation of forming the loop and folding the paper is repeated smoother to thereby make it possible to easily accommodate the paper into the paper conveying unit.

The paper feeder urging means is constructed by setting the mass of the rotatable guide member or the like. Therefore, when the rotatable guide member is lifted by a paper loop and the paper loop becomes great to some extent, the paper cannot support the weight of the rotatable guide member or the like, so that the paper is buckled and folded. It is therefore unnecessary to provide an urging member having a complicated structure. Further, the paper can be folded by a simple structure.

The above and other objects, features and advantages of the present invention will become apparent from the following description and the appended claims, taken in conjunction with the accompanying drawings in which preferred embodiments of the present invention are shown by way of illustrative example.

DETAILED DESCRIPTION OF THE PREFERRED EMBODIMENTS

Preferred embodiments of the present invention will hereinafter be described with reference to the accompanying drawings.

Figure 1:
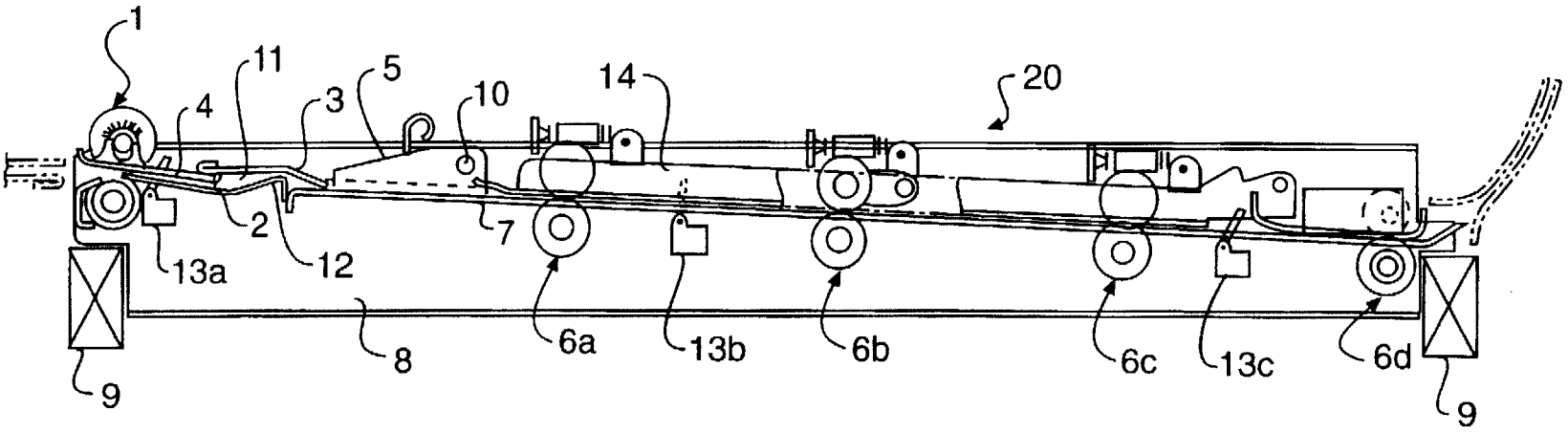
FIG. 1 is a view schematically showing the structure of a principal part of a paper feeder in one embodiment according to the present invention.
Figure 2:
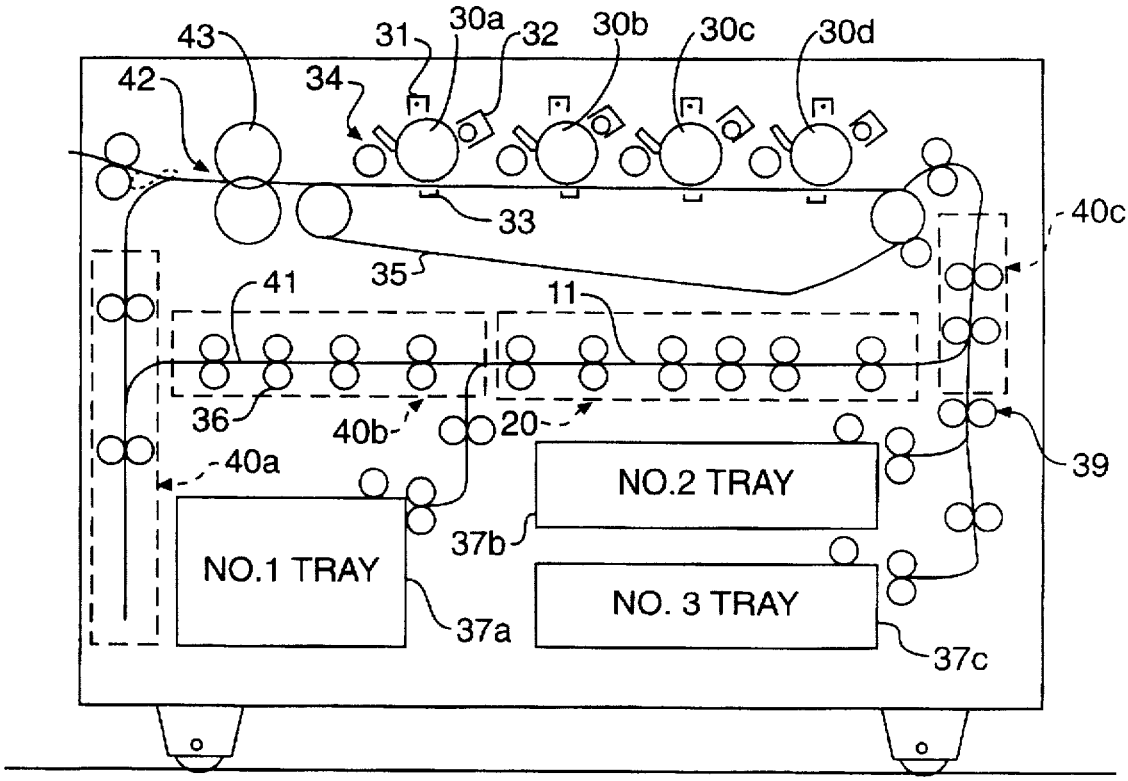
FIG. 2 is a view schematically showing the structure of an image forming apparatus to which the embodiment of the present invention is applied.

FIG. 1 is a view schematically showing the structure of principal parts of a paper feeder in one embodiment according to the present invention. FIG. 2 is a view schematically illustrating the structure of an image forming apparatus to which the paper feeder shown in FIG. 1 is applied.

In FIG. 2, the image forming apparatus has a transfer belt 35 capable of electrostatically applying a sheet of paper thereon and feeding the same and four photosensitive drums 30*a*, 30*b*, 30*c* and 30*d* (30) disposed in the position opposed to the transfer belt 35. Each of the photosensitive drums 30*a*, 30*b*, 30*c* and 30*d* is provided therearound with a transfer device 31 for uniformly charging the surface of each photosensitive drum, a developer unit 32 for applying toner on a latent image formed on each photosensitive drum and making it visible, a transfer device 33 for transferring a toner image formed on each photosensitive drum onto the paper, and a cleaning device 34 for cleaning the toner left on each photosensitive drum after the toner has been transferred onto the paper. Further, the image forming apparatus includes therein paper trays 37*a*, 37*b* and 37*c* (37) for respectively accommodating sheets of paper different in size from each other therein, a paper feeder 39 for successively taking out or extracting the sheets of paper one by one from each of the paper trays and feeding the extracted paper to the transfer belt 35, a paper feeder 42 for feeding the paper with the toner image transferred thereon, a pair of fixing rollers 43 for fixing a toner image on a sheet of paper, etc.

In the image forming apparatus referred to above, the sheets of paper are successively extracted one by one from each of the paper trays 37 that accommodate sheets of paper of selected sizes therein. Further, the extracted paper is conveyed in a predetermined direction by the paper feeder 39 so as to be fed out to the transfer belt 35 in given timing. Next, the toner images on the photosensitive drums 30 are transferred onto the paper by their corresponding transfer devices 33 so that the toner images having four colors are superposed on one another under the motion of the transfer belt 35. Thereafter, the toner images on the paper are fixed by the pair of fixing rollers 43 and the paper is discharged into the outside of the image forming apparatus.

The paper feeder 39 in the image forming apparatus comprises a guide member 41 for controlling a paper conveying path, a plurality of conveying roller pairs 36 respectively opposed to and brought into contact with each other at suitable positions of the paper conveying path and for conveying the paper held therebetween, etc. A part of the paper conveying path is formed by a plurality of paper conveying units 20, 40*a*, 40*b* and 40*c*. As shown in FIG. 1, the paper conveying unit 20 of these is supported by a support frame 8 so as to slide on a pair of rails 9 and to be withdrawable in the direction orthogonal to a paper feeding direction (i.e., the direction indicated by arrow in the drawing).

Figure 3A:
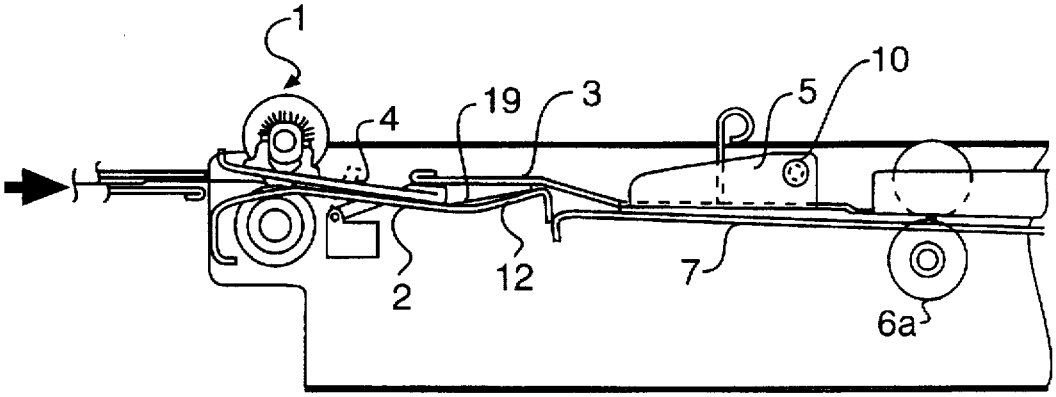
FIG. 3(*a*) and FIG. 3(*b*) are schematic views for describing the operation of the paper feeder shown in FIG. 1.
Figure 3B:
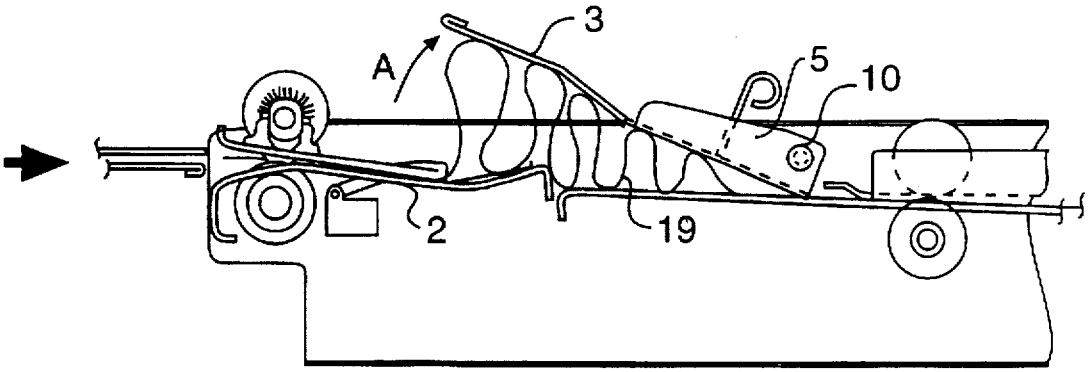

An internal structure of the paper conveying unit 20 that serves as a part of the paper feeder 39, will now be described. FIG. 3 is a schematic view for describing the operation of the paper feeder.

The paper conveying unit 20 is provided with an entrance roller pair 1 for conveying a sheet of paper in a predetermined direction (i.e., in the direction indicated by arrow) in the neighborhood of an entrance of a paper conveying path 11, an upper fixed guide member 4 and a first lower fixed guide member 2 opposed to each other so as to hold the paper conveying path 11 therebetween on the downstream side of the entrance roller pair 1 as seen in the paper feeding direction, a paper sensor 13*a* for detecting on the downstream side just below the entrance roller pair 1 whether or not the paper exists, a turnable or rotatable guide member 3 disposed on the downstream side of the upper fixed guide member 4 so as to be opposed to the fixed guide member 2, a support shaft 10 for rotatably supporting the rotatable guide member 3 on the downstream side as seen in the paper feeding direction, a jump portion 12 which convexly projects toward the rotatable guide member 3 at the position opposed to the rotatable guide member 3, a weight (urging means) 5 fixed to an upper portion of the rotatable guide member 3, a substantially horizontal second lower fixed guide member 7 provided on the downstream side of the jump portion 12, and a conveying roller pair 6*a* for feeding the paper in a predetermined direction on the downstream side of the support shaft 10.

Further, the paper conveying unit 20 includes therein an upper fixed guide member 14 opposed to the lower fixed guide member 7 on the downstream side of the conveying roller pair 6*a* with the paper conveying path 11 interposed therebetween, paper sensors 13*b* and 13*c* and conveying roller pairs 6*b* and 6*c* provided at suitable intervals along the paper conveying path 11, and a conveying roller pair 6*d* provided in the neighborhood of an exit of the paper conveying path 11 of the paper conveying unit 20.

The rotatable guide member 3 has an upstream portion rotatably supported by the support shaft 10 as indicated by arrow A in FIG. 3(*b*) with the support shaft 10 taken as the center. Further, the area of the rotatable guide member 3, the position of the support shaft 10 and the mass of the weight 5 are set in such a manner that a paper loop developed when the paper is forced into the paper conveying unit 20 can be squashed.

The jump portion 12 is set to a shape and dimensions which allow the paper transmitted therethrough to be bent in an upward direction along the movable guide member 3. A portion of the rotatable guide member 3, which is opposed to the jump portion 12, is formed so as to be able to smoothly guide the bent paper into a substantially horizontal guide portion provided on the downstream side.

Each of the paper sensors 13*a*, 13*b* and 13*c* can detect the generation of a paper jam depending on whether or not the paper fed within the paper conveying path 11 reaches its corresponding position within a predetermined time interval or whether or not the paper passes through each position within the predetermined time interval.

The length of the paper conveying unit 20, which extends in the paper feeding direction, is set to such an extent that the conveyable maximum-size paper (A3-size paper in the present embodiment) is just fit into its corresponding paper tray 37, taking into consideration the performance of removing jammed paper upon paper jamming at a location other than the location where the paper conveying unit 20 is provided.

The operation of the paper feeder will now be described.

As shown in FIG. 3(*a*), a sheet of paper 19 entered from the arrow direction along the paper conveying path 11 is bent upward along the rotatable guide member 3 when passes through the jump portion 12 and is further fed so as to be guided to the conveying roller pair 6*a*.

If the leading end portion of the paper reaches the neighborhood of a conveying roller pair 6*e* when a paper jam is detected within the paper conveying unit 20 by the paper sensors 13*b* and 13*c*, then the paper is accommodated between the upper fixed guide member 14 and the lower fixed guide member 7. On the other hand, when a paper jam is detected by the paper sensors 13*a* and 13*b*, the rear end of the paper often exists within a paper conveying unit (not shown) provided on the upstream side. The paper is continuously fed until the rear end of the paper passes through the paper sensor 13*a* in the paper conveying unit 20. At this time, the paper is bent upward at the jump portion 12. Further, the paper jam is developed within the paper conveying unit 20 so that the leading end portion of the paper is restrained from moving and pressed from behind, thereby causing a further swell in the paper at the jump portion 12. Correspondingly, a loop of the paper is formed and the rotatable guide member 3 is turned in the direction (i.e., the direction indicated by arrow A) of opening the paper conveying path 11 with the support shaft 10 as the center. When such a loop becomes great to some extent, the paper cannot bear the mass of the rotatable guide member 3 or the like. Thus, the rotatable guide member 3 is returned to the fixed guide member 2 again so that the loop of the paper is squashed.

When the feeding of the paper by the entrance roller pair 1 is further continued, a paper loop is formed again. When such a loop becomes great to some extent, it is squashed, so that loops are formed so as to be superposed on one another in wavy form as shown in FIG. 3(*b*). This operation is repeated until the rear end of the paper is detected by the sensor 13*a*. Further, the paper is folded between the rotatable guide member 3 and the fixed guide member 2 so as to be accommodated within the paper conveying unit 20.

When it is desired to remove the jammed paper, an operator pulls out the paper conveying unit 20 displayed on a display unit (not shown) to thereby remove the paper. However, when the paper conveying unit 20 is pulled out, the rotatable guide member 3 and the fixed guide member 4 restrain the paper from projecting toward the upstream side so as to make it possible to prevent the paper from breaking. Therefore, the paper that has caused the paper jam, can be easily discharged outside from the paper feeder so that a copying operation can be immediately resumed.

The folding operation becomes fast or slow according to the length or thickness of the paper. It is however possible to fold all the paper regardless of the type of paper.

Figure 4:
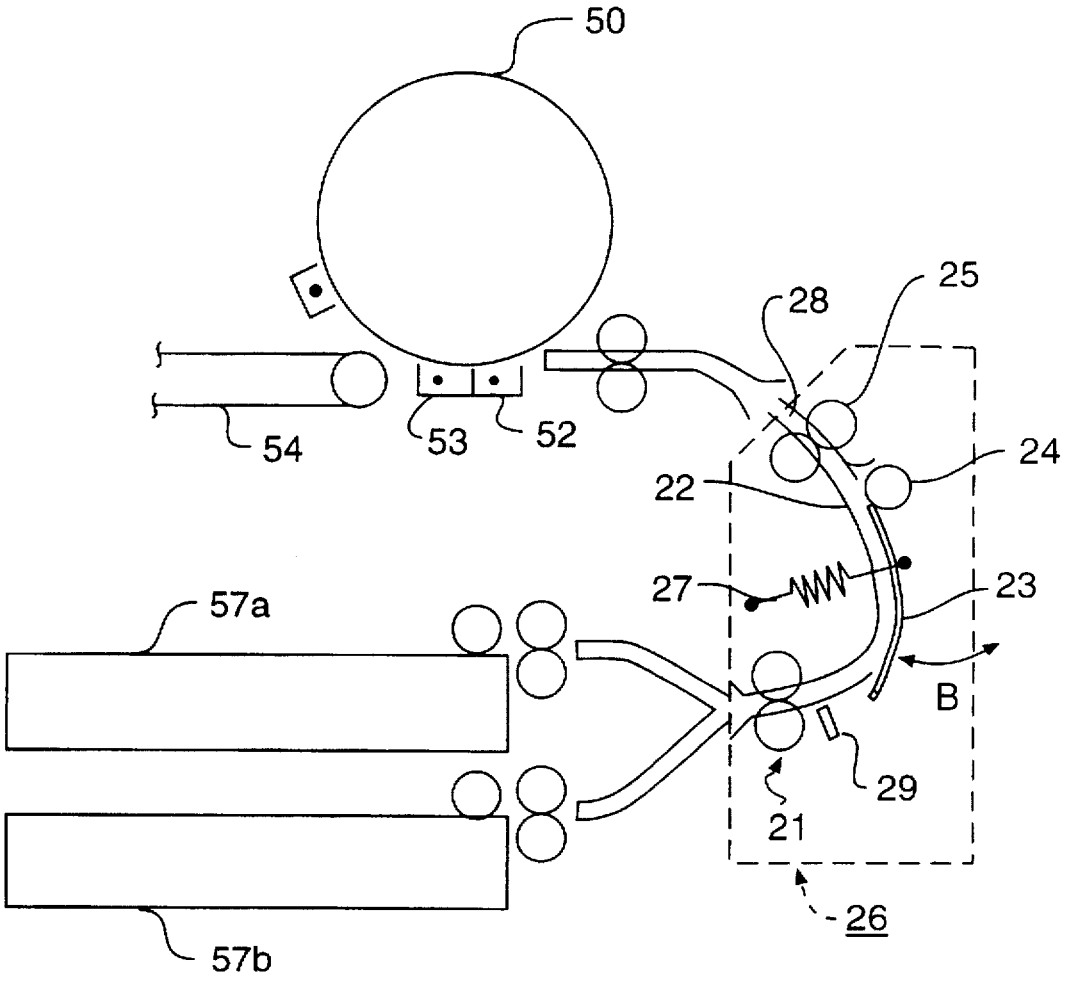
FIG. 4 is a view schematically illustrating the structure of a paper feeder in another embodiment according to the present invention.

A paper feeder in another embodiment according to the present invention will now be described. FIG. 4 is a schematic configurational view showing principal parts of both the paper feeder and an image forming apparatus provided therearound.

In FIG. 4, the paper feeder is provided so as to successively one by one feeding out sheets of paper from a paper tray 57*a* or 57*b* disposed within the image forming apparatus and successively delivering the fed-out paper to the position where a toner image on a photosensitive drum 50 is transferred by a transfer device 52.

This type of paper feeder is made up of a paper conveying unit 26 drawable in the direction in which a part of a paper conveying path 28 meets at a right angle to a paper feeding direction. In the paper conveying unit 26, a fixed guide member 22 is arcuately shaped in curve form. A turnable or rotatable guide member 23 substantially identical in shape to the fixed guide member 22 is provided at the position opposed to the fixed guide member 22. The rotatable guide member 23 is urged toward the fixed guide member 22 by a coil spring 27 and is turnably supported as indicated by arrow B in FIG. 4 with a support shaft 24 provided on the downstream side as seen in the paper feeding direction taken as the center. Further, an entrance roller pair 21 is provided in the neighborhood of an entrance of the paper conveying unit 26 and a paper sensor 29 is provided on the downstream side of the entrance roller pair 21. Furthermore, a conveying roller pair 25 is provided in the vicinity of an exit of the paper conveying unit 26. Incidentally, reference numeral 53 in FIG. 4 indicates a separator for peeling off or separating a sheet of paper with a toner image transferred thereon from the photosensitive drum 50. Reference numeral 54 indicates a conveying belt for ejecting the paper.

In the aforementioned paper feeder, the fixed guide member 22 is shaped in arcuate form. Further, the paper fed along the fixed guide member 22 is pressed from below so as to strike against the turnable guide member 23, whereby an opportunity of shaping the paper in the form of a loop can be made. Namely, when a paper jam takes place, the rear of the paper is fed into the paper conveying unit 26 by the entrance roller pair 21, thereby forming a paper loop between the fixed guide member 22 and the rotatable guide member 23. When pressure is applied to the rotatable guide member 23 by the loop, the rotatable guide member 23 is turned in the direction of opening the paper conveying path 28 as indicated by arrow B. When the loop becomes great to some extent, the rotatable guide member 23 is returned to the fixed guide member 22 by the coil spring 27 so that the loop of the paper is squashed. This operation is repeated until the rear end of the paper is fed into the paper conveying unit 26. As a result, the paper is accommodated and folded within the paper conveying unit 26.

Since the fixed guide member 22 is arcuately formed in the aforementioned paper feeder, the action similar to that of the jump portion 12 of the paper feeder shown in FIG. 1 is produced. It is therefore unnecessary to provide the jump portion 12.

In the paper feeder, as has been described above, when a paper jam takes place, a sheet of paper is folded between a rotatable guide member and a fixed guide member and is accommodated within a paper conveying unit. Therefore, the jammed paper can be easily ejected outside from the paper feeder by pulling out the paper conveying unit. Further, the paper can be prevented from breaking when the paper conveying unit is pulled out. The jammed paper can be immediately removed from the paper conveying unit, thereby making it possible to resume a copying operation.

In the paper feeder as well, an opportunity of folding the paper in loop form by a convex curved portion can be made. It is thus possible to smoothly accommodate the paper into the paper conveying unit.

Further, in the paper feeder, a paper loop is formed toward the upstream side from the neighborhood of a support point of the downstream side as seen in a paper feeding direction. Therefore, a paper folding operation is repeated smoother so that the paper can be easily held within the paper conveying unit.

In the paper feeder, an urging means is comprised of a weight such as a rotatable guide member or the like. Further, a sheet of paper can be easily folded by a simple structure without depending on a complex structure.

Having now fully described the invention, it will be apparent to those skilled in the art that many changes and modifications can be made without departing from the spirit or scope of the invention as set forth herein.

What is claimed is:

1. A paper feeder comprising:

a paper conveying unit for conveying paper in a paper conveying path and supported to be withdrawable from a part of said paper feeder at a right angle to the paper conveying path;

a transport means near an entrance of the paper conveying path in said paper conveying unit, said transport means feeding a sheet of paper into the paper conveying unit and allowing the sheet of paper to continue feeding until a rear end of the sheet of paper enters said paper conveying unit even if a paper jam is detected within said paper conveying unit;

a fixed guide member on a side of the paper conveying path extending downstream of said transport means;

a rotatable guide member opposed to said fixed guide member with the paper conveying path interposed therebetween and having a turnably-supported end thereof extending in a paper feeding direction;

a guiding portion on said fixed guide member for directing the sheet of paper into engagement with a portion of the rotatable guide member; and means for urging said rotatable guide member toward said fixed guide member;

whereby, when the paper conveying path is jammed downstream of said transport means, said transport means continues feeding the sheet of paper, and said rotatable guide member rotates to make space accommodating the sheet of paper fed by said transport means, said rotatable guide member then rotating in an opposite direction to fold the sheet of paper.

2. The paper feeder as claimed in claim 1, wherein said guiding portion includes a bent portion so as to be convex to a side of said rotatable guide member along the paper conveying path.

3. The paper feeder as claimed in claim 1, wherein said rotatable guide member is rotatably supported by a support point provided on the downstream side extending in the paper feeding direction.

4. The paper feeder as claimed in claim 1, wherein said urging means is a weight of one of said rotatable guide member and a member fixed to said rotatable guide member.

5. The paper feeder as claimed in claim 1, further comprising:

sensing means for sensing the existence of paper at a downstream side of said transport means;

jump means in convex form projecting toward said rotatable guide member at a position opposed to said rotatable guide member; and at least one conveying roller pair for feeding the paper in a predetermined direction.

* * * * *

UNITED STATES PATENT AND TRADEMARK OFFICE

CERTIFICATE OF CORRECTION

PATENT NO. : 5,727,784

DATED : March 17, 1998

INVENTOR(S) : Takizo SAGAWA

It is certified that error appears in the above-identified patent and that said Letters Patent is hereby corrected as shown below:

Claim 3, column 10, line 7, "the downstream" should read --a downstream--; and after "side", delete "extending".

Signed and Sealed this

Seventeenth Day of November, 1998

*Attest:*

*Attesting Officer*

BRUCE LEHMAN

*Commissioner of Patents and Trademarks*